US007935221B2

(12) United States Patent
Allen et al.

(10) Patent No.: US 7,935,221 B2
(45) Date of Patent: May 3, 2011

(54) SOFT SINGLE-PLY TISSUE

(75) Inventors: Peter John Allen, Neenah, WI (US); Mark Alan Burazin, Oshkosh, WI (US); Paul Myles Burden, Barrow in Furness (GB); Mark John Hassman, Oshkosh, WI (US); Mark William Sachs, Appleton, WI (US); Ashwin Haribhai Soni, Maidenbower (GB); Kevin Joseph Vogt, Neenah, WI (US); Keith William James Warner, Newby Bridge (GB); Kenneth John Zwick, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 210 days.

(21) Appl. No.: 12/431,127

(22) Filed: Apr. 28, 2009

(65) Prior Publication Data

US 2010/0051218 A1 Mar. 4, 2010

Related U.S. Application Data

(63) Continuation-in-part of application No. 12/229,652, filed on Aug. 26, 2008, now abandoned.

(51) Int. Cl.
*D21F 11/00* (2006.01)

(52) U.S. Cl. ..... 162/116

(58) Field of Classification Search ..... 162/116, 162/100; 428/153

See application file for complete search history.

(56) References Cited

U.S. PATENT DOCUMENTS

| | | | |
|---|---|---|---|
| 5,869,075 | A | 2/1999 | Krzysik |
| 7,166,189 | B2 | 1/2007 | Burazin et al. |
| 2004/0101704 | A1 | 5/2004 | Hermans et al. |
| 2005/0145353 | A1 | 7/2005 | Troxell et al. |
| 2005/0148257 | A1 | 7/2005 | Hermans et al. |
| 2005/0252626 | A1 | 11/2005 | Chen et al. |
| 2006/0086472 | A1 | 4/2006 | Hermans et al. |
| 2007/0000629 | A1 | 1/2007 | Tirimacco et al. |
| 2008/0110591 | A1 | 5/2008 | Mullally et al. |

FOREIGN PATENT DOCUMENTS

| | | |
|---|---|---|
| WO | WO 95/00706 | 1/1995 |

OTHER PUBLICATIONS

International Organization for Standardization (ISO) International Standard 4287, "Geometrical Product Specifications (GPS)—Surface Texture: Profile Method—Terms, Definitions and Surface Texture Parameters," First edition, 1997, pp. 1-25.

Tappi Official Test Method T 402 om-93, "Standard Conditioning and Testing Atmospheres for Paper, Board, Pulp Handsheets, and Related Products," published by the TAPPI Press, Atlanta, Georgia, revised 1993, pp. 1-3.

Tappi Official Test Method T 411 om-89, "Thickness (Caliper) of Paper, Paperboard, and Combined Board," published by the TAPPI Press, Atlanta, Georgia, revised 1989, pp. 1-3.

*Primary Examiner* — Mark Halpern

(74) *Attorney, Agent, or Firm* — Michael J. Sullivan; Gregory E. Croft

(57) ABSTRACT

A soft single-ply tissue sheet is produced by making a textured, high bulk, through dried tissue sheet and calendering the sheet with a high level of compression energy to substantially reduce the bulk and impart improved properties to the sheet.

11 Claims, 1 Drawing Sheet

SOFT SINGLE-PLY TISSUE

This application is a continuation-in-part of application Ser. No. 12/229,652 filed on Aug. 26, 2008 now abandoned. The entirety of application Ser. No. 12/229,652 is hereby incorporated by reference

BACKGROUND OF THE INVENTION

In many tissue markets, there is consumer demand for products having "substance-in-hand". This property is typically provided by products having two or more tissue plies. While single-ply products are advantageous from a manufacturing cost standpoint and provide a consumer benefit by eliminating ply separation, single-ply products can be stiff, harsh and very two-sided (one side feels more harsh than the other). While the harsh surface feel can be mitigated by post-treatment surface addition of lotions or polysiloxanes, these treatments entail added expense and still may be insufficient to mask the underlying harsh structural surface features of the tissue sheet. Therefore, there is a need for a single-ply product that provides a substantive soft feel to the user.

SUMMARY OF THE INVENTION

It has now been discovered that soft, single-ply tissue sheets can be made using a method which combines throughdrying with several other process features that impart a unique combination of properties to the basesheet previously only associated with two-ply products. These properties include high basis weight, low stiffness, one-sided surface feel, high cross-machine direction (CD) stretch, good bulk and good z-directional compressibility. In general, the objective of the method is to prepare a fiber network with low breaking length to reduce the relative bonded area such that the fiber network is receptive to energy input through processing. Added energy is imparted to the fiber network in several ways, including rush transfer to a transfer fabric, molding and straining the sheet into a throughdrying fabric that imparts three-dimensionality to the sheet, constraining the sheet in its strained condition while drying, and shearing and compressing the sheet in one or more calender nips. In part, the method more specifically includes the use of throughdrying fabrics that have highly topographical or three-dimensional CD surface profiles as are known to produce high-bulk tissue products. However, the resulting high-bulk tissue basesheet is thereafter heavily calendered in a manner that substantially removes much of the bulk previously imparted to the basesheet. This step, in combination with other process features described herein, results in a soft, single-ply tissue sheet with highly desirable properties, which can include combinations of low stiffness, one-sided feel, good durability, suitable bulk and roll firmness, dry resiliency and superior absorbent properties.

Hence in one aspect, the invention resides in a method of making a tissue sheet comprising: (a) forming a tissue web supported by a forming fabric; (b) dewatering the web to a consistency of from about 25 to about 35 percent while supported by the forming fabric; (c) rush transferring the dewatered web from the forming fabric to a transfer fabric, said forming fabric traveling from about 20 to about 35 percent faster than the transfer fabric; (d) transferring the foreshortened web from the transfer fabric to a textured throughdrying fabric and molding the web into the topography of the throughdrying fabric; (e) throughdrying the web to form a sheet having a bulk of about 15 cubic centimeters or greater per gram; and (f) calendering the sheet with a Compression Energy of about 0.35 Newton-millimeter or greater per square millimeter, wherein the sheet bulk is reduced about 20 percent or greater. The fibers in the newly-formed tissue web can be blended (homogeneous) or layered depending upon the specific fiber types chosen and the desired final tissue sheet properties. Layered tissue webs can be advantageous because of the flexibility to provide fibers in the outer layers which impart surface softness to the outside of the tissue sheet and fibers in the inner layer(s) that impart strength to the inner regions of the sheet. More specifically, it can be particularly advantageous to form a layered tissue web having two outer layers and one or more inner layers, said one or more inner layers containing softwood fibers and both of said outer layers containing hardwood fibers treated with a chemical debonding agent.

For purposes herein, a "textured" fabric is a fabric having what is commonly referred to as a highly three-dimensional surface structure as measured in the cross-machine direction of the fabric. There are two aspects of texture that are important for purposes of this invention. First, there must be "ups" and "downs" (surface undulations which are followed by the sheet) of sufficient magnitude to strain the sheet in the cross-machine direction as much as possible without rupturing the sheet or creating pinholes. This aspect of the fabric surface can be measured by the CD path length, the concept of which is known in the art, and is simply the ratio of the length of an imaginary line traversing the topography of the fabric from one side to the other, divided by the overall width of the fabric. Increasing the path length will increase the level of strain in the sheet. Second, the frequency of the "ups" and "downs" must be sufficiently high to create a structure that can withstand the subsequent calendering step and absorb energy. For example, merely having one or two very large undulations in the surface of the fabric may provide a path length that is sufficient to reach the maximum level of strain that the sheet can tolerate without rupturing, but the resulting structure would not be able to resist and absorb the amount of Compression Energy necessary to attain the properties of the sheets of this invention. Therefore, for purposes herein, a "textured" fabric is a fabric having a CD path length of about 1.2 or greater, more specifically from about 1.2 to about 2.0, still more specifically from about 1.5 to about 1.8. The frequency of the surface undulations in the CD can be from about 1 to about 8 per centimeter, more specifically from about 2 to about 7 per centimeter, and still more specifically from about 5 to about 7 per centimeter. The height of the individual surface undulations can be from about 0.3 to about 3.5 millimeters, more particularly from about 0.3 to about 2.0 millimeters, and still more specifically from about 0.3 to about 0.7 millimeter. In order to maximize CD strain, the surface undulations that create the texture can advantageously be continuous ridges running in the machine direction of the fabric. Spaced-apart knuckles running in the machine direction can also be used, but the spaces between the knuckles will not provide significant CD strain, so such fabrics may be particularly suitable when a textured fabric is used for the transfer fabric in addition to the textured throughdrying fabric.

For purposes herein, it is necessary that the throughdrying fabric be textured since the throughdrying fabric locks in the sheet structure and provides the desired high degree of bulk to the sheet. Optionally, the transfer fabric may also be textured, if desired, to further strain and thereby improve the resulting properties of the final tissue product. This can be advantageous depending upon the fabric designs of the transfer fabric and the throughdrying fabric. For example, as mentioned above, strain may not be uniform across the sheet, so that areas of the sheet that may be strained by the transfer fabric may not be strained by the throughdrying fabric and vice versa. Therefore, the texture of the two fabric designs can be optimized for the particular sheet properties desired. It should be noted that because of the high basis weight and resulting greater than normal thickness of the sheet, very fine surface features in a fabric will not meaningfully impact the strain of the sheet because they will be bridged by the sheet. Therefore, the surface features must be sufficiently large. The amount of CD strain imparted to the sheet by the transfer fabric can be from 0 to about 70 percent, more specifically from about 35 to about 70 percent, and still more specifically from about 60 to about 70 percent. Independently, the amount of CD strain imparted to the sheet by the throughdrying fabric can be from about 35 to about 70 percent, more specifically from about 50 to about 70 percent, and still more specifically from about 60 to about 70 percent. Suitable textured fabrics for purposes herein are disclosed in US 2008/0110591 A1 to Mullally et al., published May 15, 2008, and entitled "Rippled Papermaking Fabrics For Creped and Uncreped Tissue Manufacturing Processes", which is hereby incorporated by reference.

In another aspect, the invention resides in a single-ply tissue sheet having a finished dry basis weight from about 35 to about 120 grams per square meter, a stiffness (as measured by the ratio of the geometric mean slope in grams divided by the geometric mean tensile strength in grams per 76.2 millimeters sample width) of about 10 or less, a sheet bulk of from about 6 to about 14 cubic centimeters per gram, a surface smoothness difference of about 10 percent or less and an exponential compression modulus of about 11 or less. Optionally, the tissue sheet can be surface-treated, such as by printing or spraying, with a suitable lotion or polysiloxane(s) to further improve the surface feel of the tissue product. Suitable lotions include, without limitation, hydrophilic compositions comprising high molecular weight polyethylene glycol, a fatty alcohol and lipophilic emollients or solvents such as are disclosed in U.S. Pat. No. 5,869,075 issued Feb. 9, 1999, to Krzysik entitled "Soft Tissue Achieved by Applying a Solid Hydrophilic Lotion", which is hereby incorporated by reference.

The Compression Energy (hereinafter defined) applied to the basesheet during calendering can be about 0.35 Newton-millimeter or greater per square millimeter, more specifically from about 0.35 to about 2.20 Newton-millimeter per square millimeter (N/mm), and still more specifically from about 0.50 to about 1.50 N/mm. The Compression Energy is not simply a measure of the calendering load, but instead represents the energy applied to the sheet as a result of the interaction between the three-dimensional, high-bulk, through-dried sheet structure and the applied calendering load.

The finished dry basis weight of the tissue sheets of this invention can be from about 35 to about 120 grams per square meter (gsm), more particularly from about 35 to about 60 gsm, and still more specifically from about 40 to about 45 gsm. Such relatively high basis weights are necessary to provide the "substance in hand" deemed to be desirable to consumers.

The caliper of the tissue sheets of this invention can be about 0.25 mm or greater, more specifically from about 0.25 to about 0.65 mm, more specifically from about 0.40 to about 0.50 mm. The final caliper will depend at least in part upon the basis weight, the topography of the throughdrying fabric and the Compression Energy applied to the sheet.

The bulk of the tissue sheets of this invention, which is relatively moderate as a result of the heavy calendering step, can be from about 6 to about 14 cubic centimeters per gram (cc/g), more specifically from about 8 to about 12 cc/g, and still more specifically from about 8 to about 10 cc/g.

The machine direction (MD) tensile strength can be from about 1000 to about 2000 grams per 3 inches (76.2 mm) of width (sometimes referred to herein simply as "grams"), more specifically from about 1000 to about 1500 grams, still more specifically from about 1100 to about 1300 grams.

The cross-machine direction (CD) tensile strength can be from about 500 to about 800 grams per 3 inches (76.2 mm) of width (sometimes referred to herein simply as "grams"), more specifically from about 500 to about 700 grams, still more specifically from about 600 to about 700 grams.

The geometric mean tensile strength (GMT) can be from about 600 to about 1200 grams per 3 inches (76.2 mm) of width (sometimes referred to herein simply as "grams"), more specifically from about 700 to about 1000 grams, and still more specifically from about 800 to about 950 grams.

The geometric mean slope (GM Slope), which is a measure of stiffness, can be about 10 kilograms or less per 3 inches (76.2 mm) of width (sometimes referred to herein simply as "kilograms" (kg)), more specifically from about 5 to about 10 kg, more specifically from about 5 to about 9 kg, more specifically from about 6 to about 9 kg and still more specifically from about 7 to about 9 kg.

The ratio of the GM Slope (grams) divided by the GMT (grams per 76.2 mm), which is a further measurement of stiffness, can be about 10 or less, more specifically from about 6 to about 9, and still more specifically from about 7 to about 9.

The cross-machine direction (CD) stretch, which is a measure of stiffness and durability, can be about 5 percent or greater, more specifically from about 5 to about 10 percent, more specifically from about 6 to about 10 percent and still more specifically from about 7.5 to about 9.5 percent. The CD stretch is a function of the degree of texture (three-dimensionality) of the throughdrying fabric in the CD direction.

The ratio of the cross-machine direction tensile energy absorbed (CD TEA) (grams/cm) divided by the CD tensile strength (kilograms per 76.2 mm), which is a further measure of sheet durability, can be from about 6 to about 10, more specifically from about 6 to about 8, and still more specifically from about 7 to about 8.

The breaking length, which is calculated as the quotient of tensile strength (grams per 76.2 mm wide sample) divided by the basis weight (grams per square meter), multiplied by a conversion factor of 13.12, can be from about 200 to about 500 meters, more specifically from about 200 to about 350 meters, and still more specifically from about 200 to about 300 meters.

The surface smoothness difference, which is a measure of the one-sidedness of the sheet and is the difference in surface smoothness between both sides of the sheet, can be about 10 percent or less, more specifically about 5 percent or less, and still more specifically about 3 percent or less. In this regard, the surface smoothness of both sides of the tissue sheet can be characterized by a vertical relief parameter (hereinafter defined) from about 200 to about 500 micrometers, more specifically from about 250 to about 450 micrometers, and still more specifically from about 300 to about 400 micrometers.

The exponential compression modulus (hereinafter defined), which is a measure of the dry compression resiliency of the sheet, can be about 11 or less, more specifically from about 5 to about 10, and still more specifically from about 7 to about 9.

The absorbent capacity of the sheets of this invention can be from about 8 to about 11 grams of water per gram of fiber (g/g), more specifically from about 9 to about 10 g/g.

If the tissue sheets of this invention are converted into a roll form, the resulting rolls can have roll bulk of from about 6 to about 12 cc/g, more specifically from about 6 to about 10 cc/g and still more specifically from about 7 to about 9 cc/g. Roll bulk is simply the volume of the roll, minus the volume associated with the core and the open space within the core, divided by the weight of the tissue sheet on the roll. Such rolls can also have a roll firmness (hereinafter defined) of from about 2 to about 12 millimeters, more specifically from about 3 to about 10 millimeters, and still more specifically from about 3 to about 8 millimeters.

Test Methods

"Compression Energy" is defined as the energy required to compress the sheet from its initial basesheet caliper down to its final finished product caliper. Compression Energy (E) is calculated by integrating the compression curve from the zero load height down to the finished product caliper as:

$$E = \int_{C_{fp}}^{\infty} P\,dC$$

where P is the pressure at any given caliper C and is defined as:

$$P = P_0\left(\frac{C_0}{C}\right)^K$$

where:

"P" is the pressure (MPa);

"$P_0$" is a reference pressure equal to 0.002 MPa;

"C" is the product caliper under the pressure P (mm);

"$C_0$" is the initial caliper under the 0.002 MPa reference pressure (mm); and

"K" is the finished product exponential compression modulus.

The "exponential compression modulus" (K) is found by least squares fitting of the caliper (C) and pressure data from a compression curve for the calendered sample. The compression curve is measured by compressing a stack of sheets between parallel plates on a suitable tensile frame (for example the Alliance RT/1 from MTS® Corporation). The upper platen is to be 57 mm in diameter and the lower platen 89 mm in diameter. The stack of sheets should contain 10 sheets (102 mm by 102 mm square) stacked with their machine direction and cross-machine directions aligned. The sample stack should be placed between the platens with a known separation of greater than the unloaded stack height. The platens should then be brought together at a rate of 12.7 mm/minute while the force is recorded with a suitable load cell (say 100 N Self ID load cell from MTS® Corporation). The force data should be acquired and saved at 100 hz. The compression should continue until the load exceeds 44.5 Newtons, at which point the platen should reverse direction and travel up at a rate of 12.7 mm/minute until the force decreases below 0.18 Newtons. The platen should then reverse direction again and begin a second compression cycle at a rate of 12.7 mm/minute until a load of 44.5 Newtons is exceeded. The load data should then be converted to pressure data by dividing by the 2552 $mm^2$ contact area of the platens to give pressures in $N/mm^2$ or MPa. The pressure versus stack height data for the second compression cycle between the pressures of 0.07 kPa and 17.44 kPa is then least squares fit to the above expression after taking the logarithm of both sides to obtain:

$$ln(P)=a-Kln(C)$$

where "a" is a constant. The slope from the least squares fit is the exponential compression modulus (K). Five samples are to be tested per code and the average value of "K" reported.

By integrating the compression curve above, the Compression Energy "E" required to compress the sheet to any final caliper "C" is thus defined as follows:

$$E = \int_{C}^{\infty} P\,dC = (K-1)\frac{P_0 C_0^K}{C^{K-1}}$$

where "K" is the exponential compression modulus from the finished product test described above, C is the finished product caliper (hereinafter defined), and $C_0$ is the basesheet caliper. Note that this expression gives a lower bound for the actual energy input during calendering as the sheet typically rebounds after compressing in the calendar nip.

Sheet "bulk" is calculated as the quotient of the sheet "caliper" (hereinafter defined), expressed in microns, divided by the basis weight, expressed in grams per square meter. The resulting sheet bulk is expressed in cubic centimeters per gram. More specifically, the sheet caliper is the representative thickness of a single sheet measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

As used herein, the "geometric mean tensile strength" is the square root of the product of the machine direction tensile strength multiplied by the cross-machine direction tensile strength. The "machine direction (MD) tensile strength" is the peak load per 3 inches (76.2 mm) of sample width when a sample is pulled to rupture in the machine direction. Similarly, the "cross-machine direction (CD) tensile strength" is the peak load per 3 inches (76.2 mm) of sample width when a sample is pulled to rupture in the cross-machine direction. The "stretch" is the percent elongation of the sample at the point of rupture during tensile testing. The procedure for measuring tensile strength is as follows.

Samples for tensile strength testing are prepared by cutting a 3 inches (76.2 mm) wide by 5 inches (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333). The instrument used for measuring tensile strengths is an MTS Systems Sintech 11S, Serial No. 6233. The data acquisition software is MTS TestWorks® for Windows Ver. 3.10 (MTS Systems Corp., Research Triangle Park, N.C.). The load cell is selected from either a 50 Newton or 100 Newton maximum, depending on the strength of the sample being tested, such that the majority of peak load values fall between 10-90% of the load cell's full scale value. The gauge length between jaws is 4±0.04 inches (101.6±1 mm). The jaws are operated using pneumatic-action and are rubber coated. The minimum grip face width is 3 inches (76.2 mm), and the approximate height of a jaw is 0.5 inches (12.7 mm). The crosshead speed is 10±0.4 inches/min (254±1 mm/min), and the break sensitivity is set at 65%. The sample is placed in the jaws of the instrument, centered both vertically and horizontally. The test is then started and ends when the specimen breaks. The peak load is recorded as either the "MD tensile strength" or the "CD tensile strength" of the specimen depending on direction of the sample being tested. At least six (6) representative specimens are tested for each product or sheet, taken "as is", and the arithmetic average of all individual specimen tests is either the MD or CD tensile strength for the product or sheet.

In addition to measuring the tensile strengths, the "tensile energy absorbed" (TEA) is also reported by the MTS TestWorks® for Windows Ver. 3.10 program for each sample tested. TEA is reported in the units of grams-centimeters/centimeters squared (g-cm/cm$^2$) and is defined as the integral of the force produced by a specimen with its elongation up to the defined break point (65% drop in peak load) divided by the face area of the specimen. The "geometric mean tensile energy absorbed" (GM TEA) is the square root of the product of the MD TEA and the CD TEA.

The "geometric mean slope" (GM Slope) is the square root of the product of the machine direction tensile slope and the cross-machine direction tensile slope. It is a measure of flexibility of the tissue. The tensile slope is the least squares regression slope of the load/elongation curve described above measured over the range of 70-157 grams (force). The slope is reported in kilograms per unit elongation (i.e. 100% strain) for a 76.2 mm wide sample.

The "surface smoothness" of a tissue sheet is determined by quantitative surface measurement of texture using non-contact profilometry. The profilometry can be conducted with an optical profilometer such as the FRT Microprof® profilometer manufactured by Fries Research & Technology, GmbH, Friedrich-Ebert Strasse, 51429 Bergisch Gladbach, Germany. The instrument should be fitted with an optical sensor having a 3 millimeter vertical detection range. Profile acquisition was accomplished using a FRT Microprof non-contact profilometer with the following operating conditions:

Scan rate=300 Hz;

Vertical range=3 mm (vertical resolution=100 nm);

Scan size=10 mm×10 mm; and 300 scan lines with 300 points per line (horizontal–spatial resolution=50 μm).

Non-contact profilometry measurements are made from light reflected from the material substrate. Since tissue is not a continuous surface but contains many holes and near vertical surfaces, there are normally a number of missing and spuriously high data points. Commercial software such as FRT Mark III or equivalent can be used to perform the following functions to "clean up" the map data:

Correct invalid data points (by interpolation)—This routine identifies isolated x-y data locations where no z-value could be determined and replaces the missing or zero value with a value equal to the mean of its nearest neighbors; and De-spike (removes spurious high values)—This routine identifies isolated x-y data locations where the z-value is abnormally high, above a pre-determined threshold value, and replaces the spurious value with a value equal to the mean of its nearest neighbors.

The map data is reformatted as a Surface Data File (*.sdf), a universally recognizable file format that can be read by other surface texture analysis software.

Data analysis of the *.sdf profiles can be conducted with commercial software that follow ISO or DIN standards. Data analysis was conducted with TalyMap Universal v.3.1.10, from Taylor-Hobson Precision, Ltd. Leicester, England. The computations in this software follow ISO 4287, the International standard (revised in 1997) that describes a set of surface finish parameters used for profilometry (ISO 4287:1997—Geometrical Product Specifications (GPS)—Surface Texture: Profile method—Terms, definitions and surface texture parameters).

Apply the threshold function, which adjusts a color table such that the full range of the color table matches the full range of z-values in the map.

The parameter "Sz", also known as the "vertical relief parameter" is determined by the following method. The maximum height of an unfiltered profile "Pz", according to ISO 4287, is the average distance between the five highest peaks and five lowest valleys over the entire assessment length, also known as the 10-point height of the profile. The same calculations that are used in linear (2-D) profiles (i.e. "Pz") are extrapolated into 3-D and use the designation "Sz". In 3-D maps, a neighborhood of 3 data points by 3 data points is taken into account to accurately identify the peaks and the valleys.

The parameter "Sz" correlates with surface smoothness as detected by tissue product users. To determine surface smoothness difference, "Sz" is measured on both sides of a tissue sheet and the difference is expressed as a percentage of the larger value.

"Roll firmness" is a measure of the extent a probe can penetrate a roll of product, such as bath tissue, under controlled conditions. This test is described in U.S. Pat. No. 7,166,189, which is hereby incorporated by reference. The apparatus is available from Kershaw Instrumentation, Inc., Swedesboro, N.J. and is known as a Model RDT-101 Roll Density Tester. During the test, a roll of product being measured is supported on a spindle. When the test begins, a traverse table begins to move toward the roll. Mounted to the traverse table is a sensing probe. The motion of the traverse table causes the sensing probe to make contact with the side of the product roll. When the sensing probe contacts the roll, the force exerted on the load cell exceeds the low set point of 6 grams and the displacement display is zeroed and begins indicating the penetration of the probe. When the force exerted on the sensing probe exceeds the high set point of 687 grams, the traverse table stops and the displacement display indicates the penetration in millimeters. This reading is recorded. Next, the roll of product is rotated 90° on the spindle and the test is repeated. The roll firmness value is the average of the two readings, expressed in millimeters. The test is performed in a controlled environment of 23±1° C. and 50±2% relative humidity. The rolls are conditioned in this environment at least 4 hours before testing.

"Absorbent capacity" is a measure of the amount of water absorbed by the tissue sheet, expressed as grams of water absorbed per gram of fiber (dry weight). In particular, the vertical absorbent capacity is determined by cutting a sheet of the product to be tested into a square measuring 100 millimeters by 100 millimeters (±1 mm.) The resulting test specimen is weighed to the nearest 0.01 gram and the value is recorded as the "dry weight". The specimen is attached to a 3-point clamping device and hung from one corner in a 3-point clamping device such that the opposite corner is lower than the rest of the specimen, then the sample and the clamp are placed into a dish of water and soaked in the water for 3 minutes (±5 seconds). The water should be distilled or deionized water at a temperature of 23±3° C. At the end of the soaking time, the specimen and the clamp are removed from the water. The clamping device should be such that the clamp area and pressure have minimal effect on the test result. Specifically, the clamp area should be only large enough to hold the sample and the pressure should also just be sufficient for holding the sample, while minimizing the amount of water removed from the sample during clamping. The sample specimen is allowed to drain for 3 minutes (±5 seconds). At the end of the draining time, the specimen is removed by holding a weighing dish under the specimen and releasing it from the clamping device. The wet specimen is then weighed to the nearest 0.01 gram and the value recorded as the "wet weight". The absorbent capacity in grams per gram=[(wet weight−dry weight)/dry weight]. At least five (5) replicate measurements are made on representative samples from the same roll or box of product to yield an average absorbent capacity value.

In the interests of brevity and conciseness, any ranges of values set forth in this specification contemplate all values within the range and are to be construed as written description support for claims reciting any sub-ranges having endpoints which are whole numbers or otherwise of like numerical values within the specified range in question. By way of a hypothetical illustrative example, a disclosure in this specification of a range of from 1 to 5 shall be considered to support claims to any of the following ranges: 1-5; 1-4; 1-3; 1-2; 2-5; 2-4; 2-3; 3-5; 3-4; and 4-5. Similarly, a disclosure in this specification of a range from 0.1 to 0.5 shall be considered to support claims to any of the following ranges: 0.1-0.5; 0.1-0.4; 0.1-0.3; 0.1-0.2; 0.2-0.5; 0.2-0.4; 0.2-0.3; 0.3-0.5; 0.3-0.4; and 0.4-0.5. In addition, any values prefaced by the word "about" are to be construed as written description support for the value itself. By way of example, a range of "from about 1 to about 5" is to be interpreted as also disclosing and providing support for a range of "from 1 to 5", "from 1 to about 5" and "from about 1 to 5".

DETAILED DESCRIPTION OF THE DRAWINGS

Figure 1:
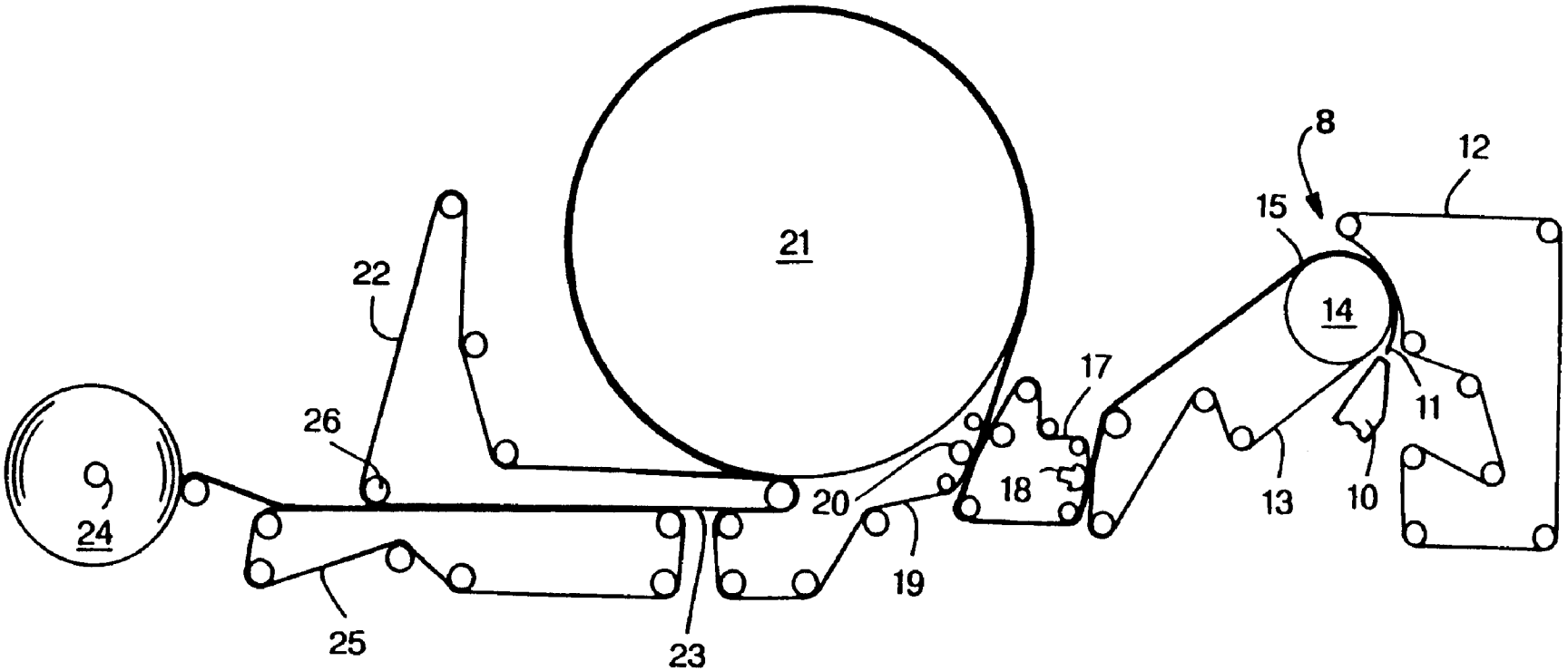
FIG. 1 is a schematic process diagram of a method of making a tissue sheet in accordance with this invention.

Referring to FIG. 1, a method of carrying out the invention is described. Shown is a twin wire former having a layered papermaking headbox 10 which injects or deposits a layered stream 11 of an aqueous suspension of papermaking fibers between forming fabrics 12 and 13. Suitable papermaking fibers for the inner layer or layers include relatively long papermaking fibers, such as softwood kraft fibers, which impart a core of strength to the resulting sheet. Suitable papermaking fibers for the two outer layers include relatively short (weaker) fibers, such as eucalyptus fibers, which impart surface softness (fuzziness) to the two outer layers of the sheet. Other papermaking fibers which serve these purposes are well known in the papermaking art. In addition, debonding chemicals, which are well known in the art, can be added to the outer layer fiber furnishes in order to weaken the bonding strength of the outer layers and thereby further soften the surface feel of the resulting tissue sheet. Suitable classes of debonding chemicals include cationic charged surface active agents. A particularly suitable commercially available debonder is Prosoft TQ1003, available from Hercules, Inc., Wilmington, Del.

The resulting layered web is transferred to fabric 13, which serves to support and carry the newly-formed wet web downstream in the process as the web is partially dewatered to a consistency of about 10-12 dry weight percent. Additional dewatering of the wet web can be carried out, such as by vacuum suction, while the wet web is supported by the forming fabric. Advantageously, the resulting consistency of the further-dewatered web can be from about 25 to about 35 percent.

The dewatered wet web is then transferred from the relatively flat forming fabric to a transfer fabric 17, which may optionally be textured, traveling at a slower speed than the forming fabric (rush transfer) in order to impart increased MD stretch into the web. Transfer is carried out to avoid compression of the wet web, preferably with the assistance of a vacuum, such as vacuum shoe 18. The rush transfer foreshortens the web in the machine direction by creating micro-folds in the sheet and increases the dry basis weight of the web by about 20-35 percent. Additionally, the wet web is molded into the textured topography of the transfer fabric, if any, at the point of vacuum transfer, which serves to improve the final sheet properties, particularly cross-machine direction properties such as CD stretch and CD tensile energy absorbed (CD TEA).

The web is then transferred from the transfer fabric to a textured throughdrying fabric 19 with the aid of a vacuum transfer roll 20 or a vacuum transfer shoe. The throughdrying fabric 30 can be traveling at about the same speed or a different speed relative to the transfer fabric. If desired, the throughdrying fabric can be run at a slower speed to further enhance MD stretch. Transfer is preferably carried out with vacuum assistance to ensure deformation and reconfiguration of the web from the topography of the transfer fabric to conform to that of the textured topography of the throughdrying fabric, thus yielding desired bulk, CD stretch and appearance. 1

The level of vacuum used for the web transfers can be from about 3 to about 15 inches of mercury (75 to about 380 millimeters of mercury), preferably about 10 inches (254 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric, the web is final dried to a consistency of about 94 percent or greater, more specifically from about 97 to about 99 percent, by the throughdryer 21 and thereafter optionally transferred to a carrier fabric 22. The dried basesheet 23 can be transported to the reel 24 using carrier fabric 22 and an optional carrier fabric 25 and wound into a parent roll. An optional pressurized turning roll 26 can be used to facilitate transfer of the web from carrier fabric 22 to fabric 25. Suitable carrier fabrics for this purpose are Albany International 84M or 94M and Asten 959 or 937, all of which are relatively smooth fabrics having a fine pattern.

The textured basesheet, which can have a bulk of about 15 cubic centimeters or greater per gram, more specifically from about 15 to about 25 cc/g, and still more specifically from about 15 to about 20 cc/g, is subsequently calendered as described herein to substantially reduce the bulk, reduce the stiffness, increase softness and increase the one-sidedness of the tissue sheet. More specifically, calendering can be carried out in a steel/steel nip or a steel/rubber nip (rubber roll hardness of about 4 P&J or greater) to reduce the sheet bulk about 20 percent or greater, more specifically from about 30 to about 70 percent, and still more specifically from about 40 to about 50 percent. By using this method on a sheet of high basis weight and high bulk, it is possible to create one-ply tissue sheets with a superior strength/stiffness characteristic, as well as other properties as described herein, than previously achieved in single-ply tissue products.

EXAMPLES

In order to illustrate this invention, an uncreped throughdried tissue was produced using the method substantially as illustrated in FIG. 1. More specifically, a three-layered single-ply bath tissue was made in which the outer layers consisted of debonded eucalyptus fibers and the center layer consisted of refined northern softwood kraft fibers. Prior to formation, the eucalyptus fibers were pulped for 15 minutes at 10 percent consistency. The softwood fibers were pulped for 30 minutes at 4 percent consistency and diluted to about 3 percent consistency after pulping, while the pulped eucalyptus fibers were also diluted to about 3 percent consistency. The overall layered sheet weight was split 30%/40%/30% among eucalyptus/refined softwood/eucalyptus layers. The center layer was refined to levels required to achieve target strength values, while the outer layers provided the surface softness and bulk. Parez 631NC, a glyoxalated polyacrylamide wet-strength resin obtained from Cytec Industries, was added to the center layer at 10-13 pounds (4.5-5.9 kilograms) per tonne of pulp based on the center layer.

A three layer headbox was used to form the wet web with the refined northern softwood kraft stock in the center layer. Turbulence-generating inserts recessed about 3 inches (75 millimeters) from the slice and layer dividers extending about one-half inch (12 millimeters) beyond the slice were employed. The net slice opening was about 0.7 inch (18 millimeters) and water flows in all three headbox layers were comparable. The consistency of the stock fed to the headbox was about 0.23 weight percent.

The resulting three-layered sheet was formed on a twin-wire, suction form roll former with forming fabrics (12 and 13 in FIG. 1) being Voith Fabrics 2184-E43S and Albany Microtex 230 fabrics, respectively. The speed of the forming fabrics was 8.6 meters per second. The newly-formed web was then dewatered to a consistency of about 29 percent using vacuum suction from below the forming fabric before being transferred to the transfer fabric, which was traveling at 6.7 meters per second (28 percent rush transfer). A vacuum shoe pulling about 10-12 inches (250-300 millimeters) of mercury vacuum was used to transfer the web to the transfer fabric.

The web was then transferred to a throughdrying fabric. The throughdrying fabric was traveling at a speed of about 6.8 meters per second. The web was carried over a Honeycomb throughdryer operating at a temperature of about. 215° C. and dried to final dryness of about 97-99 percent consistency.

The resulting uncreped tissue basesheet was then calendered in a dual nip steel on rubber calendering process. The basesheet was first calendered with a 4 P&J rubber-on-steel nip at a pressure pulse approximately equal to 18.2 kpa-seconds. The sheet was then calendered with a 40 P&J rubber-on-steel nip at a pressure pulse approximately equal to 8.6 kpa-seconds.

Example 1

Invention

A tissue sheet was produced as described above, but using a textured throughdrying fabric. Specifically, the textured throughdrying fabric was a Voith Fabrics "Jack" t1207-12 fabric as described in Table 1 of Mullally et al., previously incorporated by reference. The textured throughdrying fabric had a CD path length of about 1.6. The textured transfer fabric was a Voith Fabrics "Jetson" t1207-6 fabric as described in Table 1 of Mullally et al. The textured transfer fabric had CD path length of about 1.6. The resulting basesheet had the following properties: bone dry basis weight, 43.7 gsm; 1-sheet caliper, 0.0289 inch (0.73 mm); and sheet bulk, 16.8 cc/g.

The basesheet was then calendered as described above. The Compression Energy applied to the basesheet was 1.06 N mm/mm$^2$.

The resulting calendered tissue sheet had the following properties: basis weight, 40.6 gsm; sheet caliper, 0.0155 inch (0.39 mm); sheet bulk, 9.7 cc/g; GM Slope, 7.57 kg per 76.2 mm sample width; MD tensile strength, 1106 grams per 76.2 mm sample width; CD tensile strength, 771 grams per 76.2 mm sample width; GMT, 923 grams per 76.2 mm sample width; CD stretch, 7.74 percent; GM Slope/GMT, 8.2; CD TEA/CD tensile, 7.3; exponential compression modulus, 8.3; breaking length, 298 meters; and absorbent capacity, 9.9 g/g.

The calendered sheet was wound into a finished roll with a roll bulk of 8.2 cc/g and a roll firmness of 4.0 mm.

Example 2

Invention

A tissue sheet was produced as described in Example 1 above, but using a different textured transfer fabric. The textured transfer fabric was a Voith Fabrics t807-1 fabric, which had CD path length of about 1.4. The resulting basesheet had the following properties: bone dry basis weight, 44.1 gsm; 1-sheet caliper, 0.0283 inch (0.72 mm); and sheet bulk, 16.3 cc/g.

The basesheet was then calendered as described above. The Compression Energy applied to the basesheet was 0.39 N mm/mm$^2$.

The resulting calendered tissue sheet had the following properties: basis weight, 42.1 gsm; sheet caliper, 0.0159 inch (0.40 mm); sheet bulk, 9.6 cc/g; GM Slope, 7.99 kg per 76.2 mm sample width; MD tensile strength, 1236 grams per 76.2 mm sample width; CD tensile strength, 814 grams per 76.2 mm sample width; GMT, 1003 grams per 76.2 mm sample width; CD stretch, 6.57 percent; GM Slope/GMT, 7.96; CD TEA/CD tensile, 7.0; exponential compression modulus, 7.5; breaking length, 313 meters; and absorbent capacity, 9.7 g/g.

The calendered sheet was wound into a finished roll with a roll bulk of 8.1 cc/g and a roll firmness of 4.4 mm.

Example 3

Comparative

A tissue sheet was produced as described in Example 1 above, but using a non-textured throughdrying fabric. Specifically, the throughdrying fabric was a Asten Johnson 934 throughdrying fabric installed with the long warps to the sheet and having a CD path length of about 1.0. The resulting basesheet had the following properties: basis weight, 44.24 gsm; sheet caliper, 0.0207 inch (0.53 mm); and sheet bulk, 11.9 cc/g.

The basesheet was then calendered as described above. The Compression Energy applied to the basesheet was 0.34 N mm/mm$^2$, which was lower than that of Example 1, partially because of the lower bulk (caliper) of the basesheet being calendered.

The resulting calendered tissue sheet had the following properties: basis weight, 42.5 gsm; sheet caliper, 0.0136 inch (0.35 mm); sheet bulk, 8.1 cc/g; GM Slope, 10.68 kg per 76.2 mm sample width; MD tensile strength, 1223 grams per 76.2 mm sample width; CD tensile strength, 838 grams per 76.2 mm sample width; GMT, 1012 grams per 76.2 mm sample width; CD stretch, 5.7 percent; GM Slope/GMT, 10.6; CD TEA/CD tensile, 6.6; exponential compression modulus, 9.7; breaking length, 312 meters; and absorbent capacity, 8.5 g/g.

The calendered sheet was wound into a finished roll with a roll bulk of 6.85 cc/g and a roll firmness of 3.0 mm.

These examples demonstrate the significant benefit that the choices of transfer fabric and TAD fabric can have on finished product attributes. In the inventive Examples 1 and 2, the fabrics chosen resulted in more compression energy imparted to the sheet, compared to Example 3, even though the calendering load was the same in all three examples. This benefit is further seen in advantaged product attributes at equivalent finished product GMT and basis weight, including: superior flexibility, as seen for example in higher CD stretch and lower GM Slope/GMT; and superior durability, as seen for example in higher CDTEA/CDT, while simultaneously delivering a combination of roll bulk and roll firmness superior to Example 3.

It will be appreciated that the foregoing examples, given for purposes of illustration, are not to be construed as limiting the scope of this invention, which is defined by the following claims and all equivalents thereto.

We claim:

1. A single-ply tissue sheet having a finished dry basis weight from about 35 to about 120 grams per square meter, a ratio of the geometric mean slope divided by the geometric mean tensile strength of about 10 or less, a sheet bulk of from about 6 to about 14 cubic centimeters per gram, a surface smoothness difference of about 10 percent or less and an exponential compression modulus of about 11 or less.

2. The tissue sheet of claim 1 having a basis weight of from about 35 to about 60 grams per square meter.

3. The tissue sheet of claim 1 having a ratio of the geometric mean slope divided by the geometric mean tensile strength from about 6 to about 9.

4. The tissue sheet of claim 1 having a sheet bulk from about 8 to about 12 cubic centimeters per gram.

5. The tissue sheet of claim 1 having a surface smoothness difference of about 5 percent or less.

6. The tissue sheet of claim 1 having an exponential compression modulus from about 5 to about 10.

7. The tissue sheet of claim 1 having a cross-machine direction stretch from about 5 to about 10 percent.

8. The tissue sheet of claim 1 having a ratio of the cross-machine direction tensile energy absorbed divided by the cross-machine direction tensile strength from about 6 to about 10.

9. The tissue sheet of claim 1 having a breaking length from about 200 to about 500 meters.

10. The tissue sheet of claim 1 having an absorbent capacity from about 8 to about 11 grams of water per gram of fiber.

11. A roll of a single-ply tissue sheet, said tissue sheet having a finished dry basis weight from about 35 to about 120 grams per square meter, a ratio of the geometric mean slope divided by the geometric mean tensile strength of about 9 or less, a sheet bulk of from about 6 to about 14 cubic centimeters per gram, a surface smoothness difference of about 10 percent or less and an exponential compression modulus of about 11 or less, said roll having a roll bulk from about 6 to about 12 cubic centimeters per gram and a roll firmness from about 2 to about 12 millimeters.

* * * * *